US006206982B1

(12) United States Patent
Hughes et al.

(10) Patent No.: US 6,206,982 B1
(45) Date of Patent: Mar. 27, 2001

(54) PROCESS AND SOLUTION FOR PROVIDING A CONVERSION COATING ON A METAL SURFACE

(75) Inventors: Anthony Ewart Hughes, Olinda; Terence William Turney, Mount Waverley; Karen Joy Hammon Nelson, Clayton, all of (AU)

(73) Assignee: Commonwealth Scientific and Industrial Research Organisation, Australian Capital Territory (AU)

( * ) Notice: Subject to any disclaimer, the term of this patent is extended or adjusted under 35 U.S.C. 154(b) by 0 days.

(21) Appl. No.: 08/836,307

(22) PCT Filed: Nov. 10, 1995

(86) PCT No.: PCT/AU95/00745

§ 371 Date: Jul. 24, 1997

§ 102(e) Date: Jul. 24, 1997

(87) PCT Pub. No.: WO96/15292

PCT Pub. Date: May 23, 1996

(30) Foreign Application Priority Data

Nov. 11, 1994 (AU) ..... PM9404
May 17, 1995 (AU) ..... PN3028

(51) Int. Cl.[7] ..... C23C 22/48
(52) U.S. Cl. ..... 148/273; 148/275
(58) Field of Search ..... 148/270, 273, 148/275, 281, 262

(56) References Cited

U.S. PATENT DOCUMENTS

| | | | | |
|---|---|---|---|---|
| 3,969,152 | | 7/1976 | Melotik . | |
| 4,233,088 | * | 11/1980 | Kronstein | 428/472.3 |
| 4,264,278 | | 4/1981 | Weingart . | |
| 4,298,404 | | 11/1981 | Greene . | |
| 4,310,390 | | 1/1982 | Bradley et al. . | |
| 4,349,392 | | 9/1982 | Huvar . | |
| 4,359,347 | * | 11/1982 | Da Fonte, Jr. | 148/270 |
| 4,711,667 | | 12/1987 | Bibber . | |
| 4,725,375 | | 2/1988 | Fujii et al. . | |
| 4,755,224 | | 7/1988 | Bibber . | |
| 4,851,148 | | 7/1989 | Yamosoe et al. . | |
| 4,878,963 | | 11/1989 | Bibber . | |
| 4,921,552 | | 5/1990 | Sander et al. . | |
| 4,988,396 | | 1/1991 | Bibber . | |
| 5,030,323 | | 7/1991 | Awad . | |
| 5,118,356 | | 6/1992 | Darmon et al. . | |
| 5,192,374 | | 3/1993 | Kindler . | |
| 5,194,138 | | 3/1993 | Mansfeld et al. . | |
| 5,198,141 | | 3/1993 | Darmon et al. . | |
| 5,221,371 | | 6/1993 | Miller . | |
| 5,356,492 | | 10/1994 | Miller . | |
| 5,362,335 | | 11/1994 | Rungta . | |
| 5,383,982 | * | 1/1995 | Hauffe et al. | 148/262 |
| 5,520,750 | * | 5/1996 | Riley | 148/261 |

FOREIGN PATENT DOCUMENTS

| | | |
|---|---|---|
| 22855/92 | 9/1992 | (AU) . |
| 0 127 572 A2 | 12/1984 | (EP) . |
| 0 331 284 A1 | 9/1989 | (EP) . |
| 0 367 504 | 5/1990 | (EP) . |
| 0 488 430A2 | 3/1992 | (EP) . |
| 95 92 1651 | 7/1992 | (EP) . |
| 0603 921 A1 | 6/1994 | (EP) . |
| 0603 921 B1 | 6/1994 | (EP) . |
| 1368230 | 7/1972 | (GB) . |
| 2 059 445 | 4/1981 | (GB) . |
| 2 097 024 | 10/1982 | (GB) . |
| 88/06639 | 9/1988 | (WO) . |
| 95/00340 | 10/1994 | (WO) . |
| WO95/08008 | 3/1995 | (WO) . |
| WO96/11290 | 4/1996 | (WO) . |
| WO96/ 11290A | 4/1996 | (WO) . |

OTHER PUBLICATIONS

139 Galvanotechnik 85 (1994) Juni, No. 6, Saulgau (Wurtt.), DE (Abstract).

D.R. Arnott, N.E. Ryan, B.R.W. Hinton, B.A. Sexton and A.E. Hughes, "Auger and XPS Studies of Cerium Corrosion Inhibition on 7075 Aluminum Alloy", Applications of Surface Science 22/23 (1985) 235–251, North–Holland, Amsterdam; Elsevier Science Publishers B.V. (North–Holland Physics Publishing Division).

R.G. King, "*Surface Treatment and Finishing of Aluminum*", Chapter 6, Pergamon Press, 1988.

Abstract—Bibber, J.W., "Corrosion resistant coating composition for aluminum and its alloys—contains alkali metal permanganate and has basic pH".

Abstract—Bibber, J.W., "Corrosion resistant vonversion coating prepn. for alumninum alloys—by typically treating alloy with aluminum and alkali metal nitrate compsn. then alkali metal permanganate compsn.".

Abstract—Bibber, J.W., "Non Toxic corrison resistant coating for aluminum and alloys—applied from a soln. contg. alkali metal permanganate".

Abstract—Bibber, J.W., "Corrosion resistant coating composition for aluminum alloys—which comprises potassium permanganate and borax, etc. in aq. soln.".

* cited by examiner

*Primary Examiner*—John Sheehan
*Assistant Examiner*—Andrew L. Ottmans
(74) *Attorney, Agent, or Firm*—McDermott, Will & Emery

(57) ABSTRACT

A process and an aqueous, acidic solution for forming a rare earth element containing coating on the surface of a metal, said solution including effective quantities of: (a) one or more rare earth element containing species including at least one rare earth element capable of having more than one higher valence state, as herein defined; and (b) one or more additives selected from the groups including: i) aqueous metal complexes including at least one peroxo ligand; and ii) metal salts or aqueous metal complexes of a conjugate base of an acid in which the metals are selected from Transition Elements and Group IVA elements of the Periodic Table as herein defined.

59 Claims, No Drawings

PROCESS AND SOLUTION FOR PROVIDING A CONVERSION COATING ON A METAL SURFACE

FIELD OF THE INVENTION

This invention relates to a process for forming a conversion coating on metal surfaces and a solution for use in said process. The invention extends to the conversion coated metal thus formed. The invention is particularly concerned with a process and solution for forming a conversion coating on aluminium or aluminium alloy, and the conversion coated aluminium or aluminium thus formed.

BACKGROUND OF THE INVENTION

The term "conversion coating" is a well known term of the art and refers to the replacement of native oxide on the surface of a metal by the controlled chemical formation of a film. Oxides or phosphates are common conversion coatings. Conversion coatings are used on metals such as aluminium, iron, zinc, cadmium or magnesium and their alloys, and provide a key for paint adhesion and/or corrosion protection of the substrate metal. Accordingly, conversion coatings find application in such areas as the aerospace, architectural and building industries.

Known methods for applying conversion coatings to metal surfaces include treatment with chromate or phosphate solutions, or mixtures thereof. However, in recent years it has been recognised that the hexavalent chromium ion, $Cr^{6+}$, is a serious environmental and health hazard. Phosphate ions can also be detrimental, particularly when they find their way into natural waterways and cause algal blooms. Consequently, strict restrictions have been placed on industrial processes and limitations have been placed on the release of such solutions to the environment. This leads to costly effluent processing.

In the search for alternative, less toxic conversion coatings, research has been conducted on conversion coatings based on rare earth compounds. One prior conversion coating process has been described in Australian patent specification AU-A-14858/88 which is incorporated herein by reference. That conversion coating process comprises contacting a metal surface with a solution formed by an aqueous acidic solution containing cerium and $H_2O_2$ in which some or all of the cerium has been oxidised to the +4 valence state. It is asserted in AU-A-14858/88 that an increase in the solution pH in the region of the metal surface to a sufficiently high value causes precipitation of a cerium containing coating on the metal surface.

There is, however, considerable room for improvement in the properties of prior rare earth element based conversion coatings, such as adhesion, and in the time required to deposit those coatings. The need for improvement is particularly true for conversion coatings on certain metal alloys, such as 3000, 5000 and 6000 series aluminium alloys, which coatings can be slow to deposit and have variable adherence or no adherence.

Accordingly, it is an object of the present invention to provide a process and solution for forming a conversion coating on a metal surface which overcome, or at least alleviate, one or more of the disadvantages or deficiencies of the prior art. It is also an object of the present invention to provide conversion coated metal surface formed by the process of the invention.

It has been discovered that addition of one or more additives, having particular compositions, to the coating solution can assist in accelerating the coating process and/or improving adhesion of the conversion coating to the metal surface.

Throughout the specification, reference will be to the CAS version of the Periodic Table, as defined in (for example) Chemical and Engineering News, 63(5), 27, 1985. Furthermore, as used herein, the term "transition elements" or "transition metals" refers to the elements of the Periodic Table from scandium to zinc inclusively, yttrium to cadmium inclusively and lanthanum to mercury inclusively. Moreover, as used herein, the term "rare earth" elements, metals or cations refer to the elements of the Lanthanide series, namely those having the atomic number 57 to 71 (La to Lu), plus scandium and yttrium. In addition, the term "higher valence state" means a valence state above zero valency.

SUMMARY OF THE INVENTION

According to the present invention, there is provided an aqueous, acidic solution for forming a rare earth element containing coating on the surface of a metal, said solution including effective quantities of:

(a) one or more rare earth element containing species, including at least one rare earth element capable of having more than one higher valence state; and (b) one or more additives selected from the groups including:

(i) aqueous metal complexes including at least one peroxo ligand; and (ii) metal salts or metal complexes of a conjugate base of an acid in which the metals are selected from Transition Elements and Group IVA elements of the Periodic Table.

The invention also provides a process for forming a coating on the surface of a metal, in which the metal surface is contacted with an aqueous, acidic solution including effective quantities of:

(a) one or more rare earth element containing species, including at least one rare earth element capable of having more than one higher valence state; and (b) one or more additives selected from the groups including:

(i) aqueous metal complexes including at least one peroxo ligand; and (ii) metal salts or metal complexes of a conjugate base of an acid in which the metals are selected from the Transition Elements and Group IVA of the Periodic Table.

The invention also extends to a metal surface having deposited thereon a conversion coating formed according to the process of the preceding paragraph.

DETAILED DESCRIPTION OF THE PREFERRED EMBODIMENTS

The invention will now be described with focus on its use for aluminium or aluminium containing alloys. However, a skilled addressee will understand that the invention is not limited to this use.

It may be appropriate for the process of the present invention to be preceded by the steps of degreasing and/or cleaning and deoxidising/desmutting the metal surface.

The degreasing step, if present, comprises treatment of the metal surface with any suitable degreasing solution to remove any oils or grease (such as lanoline) or plastic coating present on the metal surface.

The degreasing step, if present, preferably comprises treating the metal surface with a vapour degreasing agent such as tricholoroethane or an aqueous degreasing solution available under the trade name of BRULIN. A degreasing step may be necessary, for example, where the metal has been previously coated with lanoline or other oils or grease or with a plastic coating.

Subsequent to the degreasing step, the metal surface preferably undergoes a cleaning step in order to dissolve contaminants and impurities, such as oxides, from the surface of the metal. Preferably, the cleaning step comprises treatment with an alkaline based solution.

The alkaline solution is preferably a "non-etch" solution, that is, one for which the rate of etching of material from the metal surface is low. A suitable alkaline cleaning solution is that commercially available under the trade name RIDOLINE 53.

The treatment with an alkaline cleaning solution is preferably conducted at an elevated temperature, such as up to 80° C., preferably up to 70° C.

Treatment with an alkaline solution often leaves a "smut" on the surface of the metal. As used herein, "smut" is intended to include impurities, oxides and any loosely-bound intermetallic particles which as a result of the alkaline treatment are no longer incorporated into the matrix of the aluminium alloy. It is therefore preferable to treat the metal surface with a "desmutting" or deoxidizing solution in order to remove the smut from the metal surface. Removal of smut is normally effected by treatment with a desmutting (deoxidizing) solution comprising an acidic solution having effective amounts of appropriate additives. Preferably the desmutting solution also dissolves native oxide from the surface of the metal to leave a homogeneously thin oxide on the metal surface. The desmutting solution may be chromate-based. Alternatively, the desmutting solution may be phosphate based.

Alternatively again, the desmutting solution may be one which contains rare earth elements such as the solution disclosed in international patent application PCT/AU94/00539 the entire disclosure of which is incorporated herein by reference. Treatment with rare earth containing desmutting solutions can further lessen the risk to the environment and health. The rare earth element of the desmutting solution preferably should possess more than one higher valence state. Without wishing to be limited to one particular mechanism of smut removal, it is believed that the multiple valence states of the rare earth element imparts a redox function enabling the rare earth element to oxidise surface impurities and result in their removal as ions into solution. Such rare earth elements are preferably those of the lanthanide series, such as cerium, praseodymium, neodymium, samarium, europium, terbium, erbium and ytterbium. The most preferred rare earth elements are cerium and/or praseodymium and/or a mixture of rare earth elements. Preferably, the rare earth compound is cerium (IV) hydroxide, cerium sulphate, or ammonium cerium (IV) sulphate. The mineral acid is preferably sulphuric acid.

The pH of the rare earth containing desmutting solution is preferably less than 1.

The rare earth element containing coating solution of the invention contains at least one rare earth element containing species in which the rare earth element has more than one higher valence state. Again, the preferred rare earth elements are those of the lanthanide series. Examples of such rare earth elements are cerium, praseodymium, neodymium, samarium, europium, terbium, erbium and ytterbium ions. The most preferred rare earth element is cerium and/or a mixture of rare earth elements. In the case of a mixture of rare earth elements in the coating solution, typically mischmetal chlorides are used. The typical rare earth elements present in mischmetal chlorides are cerium, praseodymium and lanthanum. Lanthanum has only one higher oxidation state, namely La(III). Accordingly, the mixture of rare earth elements may include other elements in addition to the rare earth elements having more than one higher valence state.

It is particularly preferred that the rare earth element be introduced into the coating solution in the form of a soluble salt, such as cerium (III) chloride. However other suitable salts include cerium (III) sulphate or cerium (III) nitrate. It is further preferred that the cerium be present in solution as $Ce^{3+}$ cations. Accordingly, when the metal surface is reacted with the coating solution, the resulting pH increase at the metal surface indirectly results in a precipitation of a Ce IV compound on the metal surface. However, the cerium can be present in the solution as $Ce^{4+}$, if required.

Throughout the specification, values of concentration or rare earth ions in solution are usually expressed as the equivalent grams of cerium per liter of solution.

The rare earth ion is typically present in the coating solution at a concentration below 50 grams/liter, such as up to 40 g/l. Preferably, the rare earth ion concentration does not exceed 38 g/l. More preferably, the rare earth ion concentration is below 10 g/l, such as up to 7.2 g/l. The lower concentration limit may be 0.038 g/l, such as 0.38 g/l and above. Preferably, the minimum concentration of rare earth ions is 3.8 g/l.

The coating solution may also contain an oxidising agent. The oxidising agent, if present, is preferably a strong oxidant, such as hydrogen peroxide. It may be present in solution in a concentration up to the maximum commercially available concentration (usually around 30 volume %). Usually, however, the $H_2O_2$ is present at a maximum concentration of 9 volume %. In some embodiments, the $H_2O_2$ concentration is below 7.5%, preferably below 6%, more preferably below 3%. In other embodiments, particularly those solutions including metal salts or complexes from group (b) (ii) of the additives, the $H_2O_2$ concentration is preferably above or equal to 0.3%. For those same embodiments, it is further preferred that $H_2O_2$ concentration is no higher than 1.7%. More preferably, the upper concentration of the $H_2O_2$ is 0.5 volume %. In further embodiments, the $H_2O_2$ content is below 1%, preferably below 0.9%, for example about 0.3%. In still further embodiments the $H_2O_2$ concentration is preferably above 0.03%, such as above 0.15%.

The coating solution may also include a surfactant, in an effective amount, in order to lower the surface tension of the solution and facilitate wetting of the metal surface. The surfactant may be cationic or anionic. Inclusion of a surfactant is beneficial in that by reducing surface tension of the coating solution, it thereby minimises "drag-out" from the solution. "Drag-out" is an excess portion of coating solution which adheres to the metal and is removed from solution with the metal and subsequently lost. Accordingly, there is less waste and costs are minimised by adding surfactant to the coating solution. A surfactant may also help to reduce cracking in the coating. The surfactant may be present in solution at a concentration up to 0.01%, such as 0.005%. A suitable concentration may be up to 0.0025%.

The pH of the coating solution is acidic and in most embodiments the pH is below 4. Preferably, the upper pH limit is 3. More preferably, the pH is 2 or below. While the solution pH may be as low as 0.5, at such low pH values the metal surface is susceptible to etching and coating quality is undermined. The lower limit of solution pH is therefore preferably 1. More preferably, the lower limit of solution pH is 1.2.

The coating solution is used at a solution temperature below the boiling temperature of the solution. The solution temperature is typically below 100° C., such as below 75° C. Preferably, the upper temperature limit is 60° C., such as up to 50° C. In some embodiments, the preferred upper temperature limit 45° C. The lower temperature limit of the coating solution may be 0° C., although it is preferably ambient temperature.

The metal surface is contacted with the coating solution for a period of time sufficient to give a desired coating thickness. A suitable coating thickness is up to 1 $\mu$m, such as less than 0.8 $\mu$m, preferably less than 0.5 $\mu$m. Preferably, the coating thickness is in the range 0.1 to 0.2 $\mu$m.

The cleaning and coating steps may be followed by a sealing step. A sealing step can be beneficial under some circumstances. If a sealing step is used, preferably the coated metal surface is rinsed prior to and after the sealing process. The rare earth coating may be sealed by treatment with one of a variety of aqueous or non-aqueous inorganic, organic or mixed sealing solutions. The sealing solution forms a surface layer on the rare earth coating and may further enhance the corrosion resistance of the rare earth coating. Preferably the coating is sealed by an alkali metal silicate solution, such as a potassium silicate solution. An example of a potassium silicate solution which may be used is that commercially available under the trade name "PQ Kasil #2236". Alternatively, the alkali metal sealing solution may be sodium based, such as a mixture of sodium silicate and sodium orthophosphate. The concentration of the alkali metal silicate is preferably below 20%, such as below 15%, more preferably 10% or below. The lower concentration limit of the alkali metal silicate may be 0.001%, such as above 0.01%, preferably above 0.05%.

The temperature of the sealing solution may be up to 100° C., such as up to 95° C. Preferably, the solution temperature is 90° C. or lower, more preferably below 85° C., such as up to 70° C. The preferred lower limit of the temperature is preferably ambient temperature, such as from 10° C. to 30° C.

The coating is treated with the sealing solution for a period of time sufficient to produce the desired degree of sealing. A suitable time period may be up to 30 minutes, such as up to 15 minutes, and preferably is up to 10 minutes. The minimum period of time may be 2 minutes.

The silicate sealing has the effect of providing an external layer on the rare earth element coating.

The coating solution additives selected from groups (b) (i) and (ii) described above can enhance the coating adhesion to and/or rate of coating on the metal surface.

In the case of additives selected from group (b) (i), the preferred additives are aqueous metal-peroxo complexes. More preferably, the group (b) (i) additives are peroxo complexes of transition metal cations (hereinafter referred to as "transition peroxo complexes"). The following description will concentrate on use of transition peroxo complexes, however a skilled addressee will understand that the invention is not limited to this use. It is preferred that the transition metal cations are chosen from Groups IVB, VB, VIB and VIIB of the Periodic Table. The peroxo complex may be added as a preformed complex and/or formed in situ by a suitable chemical process. Typical additives include peroxo titanium complexes, such as salts of the hydrated $[TiO_2]^{2+}$ cation, peroxovanadium species, such as $[VO(O_2)_2]$, $[VO(O_2)]^+$ or $[V(O_2)_4]^{3-}$, peroxo-niobium or -tantalum complexes, such as $[M(O_2)_4]^{3-}$ (M=Nb, Ta), peroxo-molybdenum or -tungsten species, such as $MoO(O_2)_2$ or $[M(O_2)_4]^{2-}$ (M=Mo, W) or peroxo manganese complexes, such as $[Mn(O_2)_4]^{4-}$, $[MnO(O_2)_3]^{n-}$ (n=3,4), etc or mixtures thereof.

Other group (b) (i) additives may include other ligands in addition to the peroxo ligands. Examples of such additives are complexes of the general formula $[M(O)_2(O_2)(L)]$ where M may be $Cr^{VI}$, $Mo^{VI}$ or $W^{VI}$ and L may be an organic ligand. Typical organic ligands are diethylene triamine (det), 2,2,2-triethylenetetraamine (tet) and 2,3,2-triethylenetetraamine (2,3,2-tet). Another group (b) (i) additive including an organic ligand in addition to a peroxo ligand is $Zr(O)(O_2)$(2,3,2-tet).

The transition peroxo complexes are present in the coating solution in an effective quantity and may be present at a concentration of up to 500 ppm. Preferably, however, the maximum concentration of transition peroxo complexes is 250 ppm. More preferably, the maximum concentration is 180 ppm. Preferably, however, there is more than 10 ppm of the transition peroxo complex in the solution.

Alternatively, or in addition to, a transition peroxo complex, the coating solution may include a metal salt or metal complex of an acid which is dissolved in solution or formed in situ and selected from group (b) (ii) defined previously. A requirement of the metal salt or metal complex is that it includes a metal ion selected from the Transition Elements or Group IVA elements of the Periodic Table. The salt or complex may include a transition metal or Group IVA ion and one or more ions derived from various organic or inorganic acids. The organic or inorganic acid may be chosen from acids including hydrochloric acid, carboxylic acids such as acetic or benzoic acid, nitric acid, phosphoric acid, hydrofluoric acid, sulphuric acid, sulphurous acid, sulphamic acid, alkyl- or arylsulphonic acids, alkyl- or arylphosphonic acids, dicarboxylic acids, such as oxalic, citric or malonic acid, etc or mixtures thereof. Typical transition metal ions are silver, manganese, copper, zinc, ruthenium and iron cations. A typical Group IVA metal ion is tin ion.

The preferred amount of the metal complex or salt added to the coating solution varies according to the nature of the metal in the complex or salt. In the following discussion, the concentrations given are those of the chloride salt of the transition metal. However, it is to be understood that equivalent concentrations of other metal complexes or salts are within the scope of the invention.

Typically, no more than 2000 ppm of the transition metal chloride is used, although in some cases the concentration can be higher. Preferably, no less than 10 ppm of the transition metal chloride is present in solution. For salts of zinc and manganese, in most cases, relatively high concentrations are preferred. Preferably zinc is present in solution at a concentration of 2000 ppm or higher. Preferably, manganese is present at a concentration of up to 1500 ppm.

The preferred maximum concentration for copper containing salt is 100 ppm. The preferred lower concentration for copper containing salt is 50 ppm.

For an iron containing salt, the optimum concentration is around 50 ppm.

The addition of a peroxo complex or a metal complex or salt individually assists in improving coating time and/or adherence of the coating. However, a further improvement in either or both of these parameters can occur if the peroxo complex and metal complex or salt are added to the coating solution in combination. There is accordingly a synergistic effect in adding both types of additives to the coating solution together. There can also be an additional improvement when more than one additive from either or both groups is added to the coating solution.

The following Examples illustrate, in detail, embodiments of the invention. In the Examples, the term "N/A", "SN/A" and "A" mean "non-adherent", "slightly non-adherent" and "adherent", respectively, as determined by a simple tape test. The tape test involves application of adhesive tape to the coated surface, then pulling the tape off to ascertain whether the coating adheres to the metal surface. A non-adherent conversion coating is removed by the tape, whereas for a slightly non-adherent coating only loose material on the surface of the conversion coating is removed by the tape leaving an apparently intact coating behind. For adherent coatings, no coating was removed.

The term "N/C" in the Examples means no coating was deposited during the time specified.

EXAMPLES 1 to 39 AND COMPARATIVE EXAMPLES 1 to 3

Prior to treatment with the coating solutions described in the following Examples, each metal was pretreated in the following manner:

(a) Treated with an aqueous degreaser (Brulin 815 GD) at 60° C. for 10 minutes;

(b) Cleaned with alkaline cleaner (Parker and Amchem, Ridoline 53) at 70° C. for 4 minutes; and (c) Deoxidised in a rare earth containing deoxidising/desmutting solution having a cerium concentration of 0.05 molar, added as ammonium ceric sulphate and a concentration of $H_2SO_4$ of 0.5 molar at 35° C. for 10 minutes.

In each case, the test conversion coating solution contained 13.2 g/l of $CeCl_3.7H_2O$, 1% of a 30 wt % $H_2O_2$ solution (giving 0.3 wt %), and a pH of 2.0 (adjusted, if necessary, with HCl) at a temperature of 45° C.

Comparative Examples 1 to 3

Treatment of particular types of metal alloys, for example 3000, 5000 and 6000 series aluminium alloys, with the test rare earth containing coating solution without the additives of the present invention may yield less than satisfactory results as shown in Table A. Those alloys can be slow to coat and there can be little or no deposition of the rare earth coating within a reasonable time. Furthermore, the adherence of such coatings can be variable.

TABLE A

Coating Characteristics of Test Conversion Coating Solution

| Comparative Example | Alloy | Coating Time (mins.) | Coating Characteristics |
|---|---|---|---|
| 1 | 3004 | 18 | N/A |
| 2 | 5005 | >60 | N/A |
| 3 | 6061 | 18 | SN/A |

EXAMPLES 1 TO 6

TABLE I

Coating Times (minutes) and Characteristics vs Concentration of Mo-peroxo complex.

| Example | Al Alloy | 10 ppm pH = 2 | 45 ppm pH = 2 | 90 ppm pH = 2 | 115 ppm pH = 2 | 160 ppm pH = 2.2 | 160 ppm pH = 1.8 |
|---|---|---|---|---|---|---|---|
| 1 | 3004 | 35N/C | 18N/A | 10N/A | 16.5SN/A | 12SN/A | 18SN/A |
| 2 | 5005 | 35N/C | 35N/A | 35N/A | 35N/C | 20N/C | 35N/C |
| 3 | 6061 | 19A | 10A | 10SN/A | 13SN/A | 12SN/A | 15SN/A |

TABLE II

Coating Times and Characteristics vs Concentration of Ti-peroxo complex.

| Example | Al Alloy | 10 ppm pH = 2 | 20 ppm pH = 2 | 50 ppm pH = 2 | 70 ppm pH = 2 | 180 ppm pH = 1.6 |
|---|---|---|---|---|---|---|
| 4 | 3004 | 35N/C | 15N/A | 18SN/A | 30N/A | 20N/A |
| 5 | 5005 | 35N/C | 30N/A | 18N/A | 30N/C | 20N/C |
| 6 | 6061 | 19 N/A | 15 N/A | 18 A | 30N/A | 20 N/C |

As is evident from the data presented in Tables I and II, addition of an appropriate amount of a transition metal-peroxo complex to the rare earth containing coating solution can effect deposition of a conversion coating and/or decrease the time taken to deposit the conversion coating and/or improve the adherence of the conversion coating.

The effect of a particular concentration of a metal-peroxo complex varies for different alloys. However, for each Example, there is an optimum concentration of metal-peroxo complex above which the benefits of the invention decrease. For 3004 aluminium alloy (Examples 1 and 4) addition of more than 10 ppm molybdenum peroxo complex or titanium peroxo complex resulted in a coating being deposited, whereas addition of more than 90 ppm Mo peroxo complex or more than of between 10 and 50 ppm Ti peroxo complex resulted in improved adhesion of the coating. Coating time for 3004 alloy was minimised at around 90 ppm Mo-peroxo complex. Under the particular conditions of Examples 1 and 4, optimum concentrations of Mo-peroxo and Ti-peroxo complexes in terms of coating time and adhesion were around 115 to 160 ppm and 50 ppm, respectively.

For 5005 aluminium alloy, optimum adhesion and coating time occurred above 10 ppm of Mo-peroxo complex and Ti-peroxo complex (Examples 2 and 5). Above 90 ppm Mo-peroxo complex and 50 ppm Ti-peroxo complex, the benefits of the invention decreased.

Best results were obtained for 6061 aluminium alloy, in Examples 3 and 6. Coatings were deposited at concentrations of the two complexes less than 10 ppm. Optimum adhesion and coating time were obtained at around 45 ppm Mo-peroxo complex and 20 to 50 ppm Ti-peroxo complex, with the benefits of the invention decreasing at higher respective concentrations.

EXAMPLES 7 TO 27

TABLE III

Transition Metal Additions-Coating Time (Mins.) and Characteristics.

| Example | Concentration of Transition Metal(ppm) | Al Alloy | (a)Zn pH = 2.2 | (b)Mn pH = 2.2 | (c)Cu pH = 2.2 | (d)Fe pH = 2.2 |
|---|---|---|---|---|---|---|
| 7 | 10 | 3004 | 18N/A | 18N/A | 7N/A | 14N/A |
| 8 | 10 | 5005 | 25N/C | 22N/C | 16N/A | 20N/A |
| 9 | 10 | 6061 | 18N/A | 18N/A | 7N/A | 16N/A |
| | | | pH = 2.3 | pH = 2.3 | pH = 2.3 | pH = 2.3 |
| 10 | 50 | 3004 | 13N/A | 17N/A | 6N/A | 7N/A |
| 11 | 50 | 5005 | 30N/A | 30N/C | 6N/A | 19N/A |
| 12 | 50 | 6061 | 13N/A | 17N/A | 6SN/A | 12N/A |
| | | | pH = 2.2 | pH = 2.2 | pH = 2.3 | pH = 2.4 |
| 13 | 100 | 3004 | 14N/A | 20N/A | 3A | 18N/A |
| 14 | 100 | 5005 | 18N/A | 20N/C | 3SN/A | 18N/A |
| 15 | 100 | 6061 | 14SN/A | 20N/A | 3A | 18N/A |
| | | | pH = 2.3 | pH = 2.4 | pH = 2.4 | pH = 2.3 |
| 16 | 500 | 3004 | 9N/A | ION/A | 2* | 20N/C |
| 17 | 500 | 5005 | 20N/A | 20N/A | 2* | 20N/C |
| 18 | 500 | 6061 | 12N/A | 14N/A | 2* | 20N/C |
| | | | pH = 2 | pH = 2 | | |
| 19 | 1000 | 3004 | 18N/A | 16N/A | | |
| 20 | 1000 | 5005 | 25N/A | 25N/C | | |
| 21 | 1000 | 6061 | 18N/A | 16SNA | | |
| | | | pH = 1.9 | pH = 2 | | |
| 22 | 1500 | 3004 | 16N/A | 8N/A | | |
| 23 | 1500 | 5005 | 30N/C | 22N/A | | |
| 24 | 1500 | 6061 | 16N/A | 8N/A | | |
| | | | pH = 2 | pH = 2 | | |
| 25 | 2000 | 3004 | 12N/A | 10N/A | | |
| 26 | 2000 | 5005 | 18N/A | 25N/A | | |
| 27 | 2000 | 6061 | 12N/A | 10N/A | | |

*-coating was black indicating deposition of Cu.

Table III lists coating times (minutes) and coating characteristics of coatings deposited from solutions containing particular concentrations of four transition metal salts. The transition metals Zn, Mn, Cu and Fe were added to the coating solutions as their respective chlorides, i.e. as $ZnCl_2$, $MnCl_2.4H_2O$, $CuCl_2.2H_2O$ and $FeCl_2.4H_2O$.

As is evident from Table III, addition of increasing amounts of the metal salts to the rare earth containing coating solution results, generally, in a decrease in coating time for all alloys to an optimum concentration, after which in most cases, the benefits of the invention begin to decrease.

For addition of Zn, (Examples 7(a) to 27(a)), optimum results in terms of coating time and adherence were obtained at concentrations above 10 to 50 ppm, particularly around 100–500 ppm and again at higher concentrations around 2000 ppm and greater for all alloys.

For addition of Mn (Examples 7(b) to 26(b)), the optimum Mn concentration for 3004 alloy occurred above 10 ppm, particularly above 500 ppm, more particularly around 1500 ppm. Whereas for 5005 alloy, the maximum benefit in terms of coating time occurred above 100 ppm, particularly around 500 ppm. For 6061 alloy, the optimum concentration of Mn was above 500 ppm, particularly about 1000 ppm in terms of adhesion and above 1000 ppm, particularly about 1500 ppm in terms of coating time.

Relatively lower concentrations of Cu in the coating solution were effective in improving coating time. For each alloy, improvement in coating time was evident at concentration less than 10 ppm. Optimum results were obtained above 50 ppm, particularly at around 100 ppm. At higher concentrations (particularly around 500 ppm and greater), the coating quality decreased.

Lower concentrations of Fe in the coating solution were also effective in improving coating time. Concentrations lower than 10 ppm were sufficient to achieve the benefit of the invention. Optimum conditions were obtained above 10 ppm for each alloy, particularly around 50 ppm to 100 ppm. At higher concentrations (around 500 ppm or higher), no coating was deposited.

EXAMPLES 28 TO 30

TABLE IV

Method of Addition of Additives

| Example | Alloy | (a) Method 1 | (b) Method 2 | (c) Combination pH = 1.9 |
|---|---|---|---|---|
| 28 | 3004 | 13N/A | 12N/A | 9A |
| 29 | 5005 | 13N/C | 20N/C | 9A |
| 30 | 6061 | 13N/A | 12N/C | 9A |

Further improvements in coating times and coating adherence occurs when both a metal peroxo complex of group (b)

(i) and a metal salt or complex of group (b) (ii) are added in combination to the coating solution. Table IV demonstrates the synergistic effect of adding both types of additive together to the coating solution.

In Method 1, each alloy was first immersed in a solution having a pH of 2, and 10 ppm of Cu (as chloride) for 5 minutes, then immersed in the rare earth ion containing solutions (as described in the preamble to the Examples) further containing 70 ppm Ti-peroxo complexes and having a pH of 1.8.

In Method 2, the order of treatment of each alloy was reversed and the alloys were immersed in a solution having 70 ppm Ti-peroxo complex and a pH of 2, then subsequently immersed in the rare earth ion containing solution further containing 10 ppm Cu (as chloride). In each Example, the combination of the additives of solutions in Methods 1 and 2 produced a much more adherent coating on each alloy in a lower period of time, than the consecutive independent use of each additive.

EXAMPLES 31 TO 36

TABLE V

Transition Metal Salt Additions-Coating Time (Mins.) and Characteristics

| Example | Alloy | (a) Zn (50 ppm) pH = 2 | (b) Mn (50 ppm) pH = 2 | (c) Cu (10 ppm) pH = 2 | (d) Fe (50 ppm) pH = 2 | (e) Cu (10 ppm) pH = 2 |
|---|---|---|---|---|---|---|
| | | Mo-peroxo complex (90 ppm) | | | | (100 ppm) |
| 31 | 3004 | 15SN/A | 14SN/A | 8A | 13SN/A | 10A |
| 32 | 5005 | 22N/A | 22N/A | 8N/A | 20N/A | 10N/A |
| 33 | 6061 | 15A | 14A | 8A | 13SN/A | 10A |
| | | Ti-Peroxo complex (70 ppm) | | | | |
| | | pH = 2 | pH = 2 | pH = 1.9 | pH = 2.3 | |
| 34 | 3004 | 20N/C | 24N/A | 9A | 22SN/A | |
| 35 | 5005 | 20N/C | 24N/C | 9A | 22N/C | |
| 36 | 6061 | 20N/C | 24N/C | 9A | 22SN/A | |

Examples 31 to 36 further illustrate the advantage in adding both group (b) (i) and group (b) (ii) additives to the coating solution. Comparison of each of Examples 31, (a,b,c,d,e), 32(a,b,c,d,e), 33(a,b,c,d,e), 34(a,b,c,d), 35(a,b,c,d) and 36(a,b,c,d) with a corresponding, previously discussed Example and having the same concentration of metal-peroxo complex or metal salt, illustrates in most cases, the further improvement in coating time and coating adhesion that both additives in combination provide. A particularly preferred coating solution is one containing 70 ppm Ti-peroxo complex and 10 ppm Cu (Examples 34(c), 35(c) and 36(c)) which, provides an adherent coating on all three alloys in a short period of time (around 9 minutes).

EXAMPLES 37 TO 39

TABLE VI

Mixture of Additives

| Example | Alloy | Mo + Mn + Cu pH = 2.0 | 90 ppm Mo-peroxo Complex pH = 2 | 50 ppm Mn Salt pH = 2.3 | 10 ppm Cu Salt pH = 1.9 |
|---|---|---|---|---|---|
| 37 | 3004 | 5SNA | 18N/A | 17N/A | 7N/A |
| 38 | 5005 | 5SNA | 35N/C | 30N/C | 16N/A |
| 39 | 6061 | 5A | 10A | 17N/A | 7N/A |

Further improvements in coating time and/or coating adherence are possible by adding more than one additive from group (b) (ii) metal salts. As Table VI demonstrates, addition of 90 ppm Mo-peroxo complex, 50 ppm Mn salt (as chloride) and 10 ppm Cu salt (as chloride) results in faster coating times and improved adhesion of coating than for separate addition of each additive to the coating solution.

EXAMPLE 40 AND COMPARATIVE EXAMPLE 4

For each of Example 40 and Comparative Example 4, a piece of Al 5005 alloy was pretreated by abrasion of the surface, then treated with a coating solution.

TABLE VIII

Addition of Ruthenium Salt

| Example | Ru Salt (g/l) | Coating (mins) |
|---|---|---|
| 40 | $4.5 \times 10^{-4}$ | 60 |
| 4 (comp) | 0 | >60 |

The coating solution included 10 g/l $CeCl_3.7H_2O$ and 1% $H_2O_2$. The pH of the coating solution was adjusted to 2.0 with HCl addition and the coating process was conducted at a temperature of 45° C. For Example 40, the coating solution additionally included $4.5\times10^{-4}$ g/l $RuCl_3$.

The results show that the presence of ruthenium in the coating solution results in the deposition of a coating within 60 minutes. Comparative Example 4 indicates that treatment with the same solution with ruthenium omitted results in no coating being deposited after 60 minutes.

Finally, it is to be understood that various alterations, modifications and/or additions may be introduced into the compositions and/or steps previously described without departing from the spirit or ambit of the invention.

What is claimed is:

1. An aqueous, acidic solution for forming a rare earth element containing conversion coating on the surface of a metal when said surface of a metal is contacted with said solution, said solution being chromium free and consisting essentially of effective quantities, sufficient to form said rare earth containing coating, of:

(a) one or more rare earth element-containing species including at least one rare earth element capable of having more than one higher valence state; and (b) one or more additives selected from the groups consisting of:

(i) aqueous metal complexes including at least one peroxo ligand, wherein said metals are selected from Groups IVB, VB, VIB and VIIB of the Periodic Table; and (ii) metal salts of a conjugate base of an acid or aqueous metal complexes of a conjugate base of an acid in which the metals are selected from Transition Elements consisting of silver, manganese, copper, zinc, ruthenium and iron, and Group IVA elements of the Periodic Table.

2. An aqueous, acidic solution for forming a rare earth element containing coating on the surface of a metal, said solution being chromium free and including effective quantities, sufficient to form said rare earth containing coating, of:

(a) one or more rare earth element-containing species including at least one rare earth element capable of having more than one higher valence state; and (b) one or more additives selected from the groups consisting of:

(i) aqueous metal complexes including at least one peroxo ligand; and (ii) metal salts of a conjugate base of an acid or aqueous metal complexes of a conjugate base of an acid in which the metal is tin.

3. The aqueous, acidic solution of claim 1, wherein the conjugate base of an acid of group (b)(ii) is derived from one or more of the following acids:

hydrochloric acid, carboxylic acid, nitric acid, phosphoric acid, hydrofluoric acid, sulfuric acid, sulphurous acid, sulphamic acid, alkyl or arylsulphonic acids, alkyl or aryl phosphonic acids, dicarboxylic acids and mixtures thereof.

4. The aqueous, acidic solution of claim 3, wherein said acid is hydrochloric acid.

5. The aqueous, acidic solution of claim 1, wherein the one or more rare earth element containing species of group (a) contain cerium and/or a mixture of rare earth elements.

6. The aqueous, acidic solution of claim 1, wherein the rare earth element containing species of group (a) is provided by an aqueous solution of one or more of the compounds: cerium (III) chloride, cerium (III) sulphate and cerium (III) nitrate.

7. The aqueous, acidic solution of claim 1, wherein the rare earth element containing species comprises cerium containing ions at a concentration of cerium of up to 38 grams/liter.

8. The aqueous, acidic solution of claim 7, wherein the concentration of cerium is between 3.8 and 7.2 grams/liter.

9. The aqueous, acidic solution of claim 1, wherein the aqueous metal complex of group (b)(i) is formed in situ in said solution.

10. The aqueous, acidic solution of claim 1, wherein the aqueous metal complex of group (b)(i) is formed prior to its addition to said solution.

11. The aqueous, acidic solution of claim 1, wherein the aqueous metal complexes of group (b)(i) are selected from the group consisting of:

peroxo titanium complexes, peroxo vanadium complexes, peroxo niobium complexes, peroxo tantalum complexes, peroxo molybdenum complexes, peroxo tungsten complexes, peroxo manganese complexes, peroxo zirconium complexes and mixtures thereof.

12. The aqueous, acidic solution of claim 1, further including an oxidizing agent.

13. The aqueous, acidic solution of claim 12, wherein the oxidizing agent is hydrogen peroxide.

14. An aqueous, acidic solution for forming a rare earth element containing coating on the surface of a metal, said solution being chromium free and including effective quantities, sufficient to form said rare earth containing coating, of:

(a) one or more rare earth element containing species including at least one rare earth element capable of having more than one higher valence state, and (b) at least one aqueous metal complex including at least one peroxo ligand.

15. The aqueous, acidic solution of claim 14, wherein the concentration of the aqueous metal complex is between 10 and 500 ppm.

16. The aqueous, acidic solution of claim 14, wherein the concentration of the aqueous metal complex is between 10 and 250 ppm.

17. The aqueous, acidic solution of claim 14, wherein the concentration of the aqueous metal complex is between 10 and 180 ppm.

18. The aqueous acidic solution of claim 12, wherein the concentration of the oxidizing agent is between 0.3 and 1.7 volume %.

19. The aqueous, acidic solution of claim 12, wherein the concentration of the oxidizing agent is between 0.3 and 0.5 volume %.

20. The aqueous, acidic solution of claim 1, wherein the pH of the aqueous acidic solution is less than 4.

21. The aqueous, acidic solution of claim 1, wherein the pH of the aqueous acidic solution is between 1 and 2.5.

22. The aqueous, acidic solution of claim 1, wherein the temperature of the aqueous acidic solution is between ambient and 60° C.

23. An aqueous, acidic solution for forming a rare earth element containing coating on the surface of a metal, said solution being chromium free and including effective quantities, sufficient to form said rare earth containing coating, of:

one or more rare earth element-containing species including at least one rare earth element capable of having more than one higher valence state;

at least one aqueous metal complex including at least one peroxo ligand; and at least one metal salt of a conjugate base of an acid or aqueous metal complex of a conjugate base of an acid in which the metals are selected from Transition Elements, other than chromium, and Group IVA elements of the Periodic Table.

24. A process for forming a coating on the surface of a metal, comprising the step of contacting the metal surface with an aqueous, acidic solution for forming a rare earth element containing conversion coating on the surface of a metal, said solution being chromium free and consisting essentially of effective quantities, sufficient to form said rare earth containing coating, of:

(a) one or more rare earth element containing species including at least one rare earth element capable of having more than one higher valence state; and (b) one or more additives selected from the groups consisting of:

(i) aqueous metal complexes including at least one peroxo ligand, wherein said metals are selected from Groups IVB, VB, VIB and VIIB of the Periodic Table; and (ii) metal salts of a conjugate base of an acid or aqueous metal complexes of a conjugate base of an acid in which the metals are selected from Transition Elements consisting of silver, manganese, copper, zinc, ruthenium and iron, and Group IVA elements of the Periodic Table.

25. A process for forming a coating on the surface of a metal, comprising the step of contacting the metal surface with an aqueous, acidic solution being chromium free and including effective quantities, sufficient to form said rare earth containing coating, of:

(a) one or more rare earth element containing species including at least one rare earth element capable of having more than one higher valence state; and (b) one or more additives selected from the groups consisting of:

(i) aqueous metal complexes including at least one peroxo ligand; and (ii) metal salts of a conjugate base of an acid or aqueous metal complexes of a conjugate base of an acid in which the metal is tin.

26. The process of claim 24, wherein the conjugate base of an acid of group (b)(ii) is derived from one or more of the following acids:

hydrochloric acid, carboxylic acid, nitric acid, phosphoric acid, hydrofluoric acid, sulfuric acid, sulphurous acid, sulphamic acid, alkyl or arylsulphonic acids, alkyl or aryl phosphonic acids, dicarboxylic acids and mixtures thereof.

27. The process of claim 26, wherein said acid is hydrochloric acid.

28. The process of claim 24, wherein the one or more rare earth element containing species of group (a) contain cerium and/or a mixture of rare earth elements.

29. The process of claim 24, wherein the rare earth element containing species of group (a) is provided by an aqueous solution of one or more of the compounds: cerium (III) chloride, cerium (IV) sulphate and cerium (III) nitrate.

30. The process of claim 24, wherein the rare earth element containing species comprises cerium containing ions at a concentration of cerium of up to 38 grams/liter.

31. The process of claim 30, wherein the concentration of cerium is between 3.8 and 7.2 grams/liter.

32. The process of claim 24, wherein the aqueous metal complex of group (b)(i) is formed in situ in said solution.

33. The process of claim 24, wherein the aqueous metal complex of group (b)(i) is formed prior to its addition to said solution.

34. The process of claim 24, wherein the aqueous metal complexes of group (b)(i) are selected from the group consisting of:

peroxo titanium complexes, peroxo vanadium complexes, peroxo niobium complexes, peroxo tantalum complexes, peroxo molybdenum complexes, peroxo tungsten complexes, peroxo manganese complexes, peroxo zirconium complexes and mixtures thereof.

35. The process of claim 24, wherein said solution further includes an oxidizing agent.

36. The process of claim 35, wherein the oxidizing agent is hydrogen peroxide.

37. A process for forming a coating on the surface of a metal, comprising the step of contacting the metal surface with an aqueous, acidic solution being chromium free and including effective quantities, sufficient to form said rare earth containing coating of:

(a) one or more rare earth element containing species including at least one rare earth element capable of having more than one higher valence state; and (b) at least one aqueous metal complex including at least one peroxo ligand.

38. The process of claim 37, wherein the concentration of the aqueous metal complex is between 10 and 500 ppm.

39. The process of claim 37, wherein the concentration of the aqueous metal complex is between 10 and 250 ppm.

40. The process of claim 37, wherein the concentration of the aqueous metal complex is between 10 and 180 ppm.

41. The process of claim 35, wherein the concentration of the oxidizing agent is between 0.3 and 1.7 volume %.

42. The process of claim 35, wherein the concentration of the oxidizing agent is between 0.3 and 0.5 volume %.

43. The process of claim 24, wherein the pH of the aqueous acidic solution is less than 4.

44. The process of claim 24, wherein the pH of the aqueous acidic solution is between 1 and 2.5.

45. The process of claim 24, wherein the temperature of the aqueous acidic solution is between ambient and 60° C.

46. A process for forming a coating on the surface of a metal, comprising the step of contacting the metal surface with an aqueous, acidic solution being chromium free and including effective quantities, sufficient to form said rare earth containing coating, of:

one or more rare earth element-containing species including at least one rare earth element capable of having more than one higher valence state;

at least one aqueous metal complex including at least one peroxo ligand; and at least one metal salt of a conjugate base of an acid or aqueous metal complex of a conjugate base of an acid in which the metals are selected from Transition Elements, other than chromium, and Group IVA elements of the Periodic Table.

47. The process of claim 24, wherein the step of contacting the metal surface comprises contacting an aluminum or an aluminum containing alloy surface with said aqueous acidic solution.

48. The process of claim 47, wherein the aluminum containing alloy is selected from 3000, 5000 and 6000 series aluminum alloys.

49. The process of claim 47, wherein the step of contacting the metal surface with said aqueous acidic solution is preceded by the steps of degreasing and/or alkaline cleaning and desmutting the metal surface.

50. The process of claim 49, wherein the step of desmutting comprises treating the metal surface with an acidic, rare earth containing desmutting solution.

51. The process of claim 50, wherein the acidic, rare earth containing desmutting solution includes cerium and/or praseodymium and/or a mixture of rare earth elements, and $H_2SO_{4-}$.

52. The process of claim 50, wherein the acidic, rare earth containing desmutting solution has a pH of less than 1.

53. A metal surface having thereon a rare earth element containing coating formed by a process according to claim 46.

54. An aqueous, acidic solution for forming a rare earth element containing conversion coating on the surface of a metal, said solution being chromium free and including effective quantities, sufficient to form said rare earth containing coating, of:

(a) one or more rare earth element-containing species including at least one rare earth element capable of having more than one higher valence state; and (b) one or more additives selected from the groups consisting of:

(i) aqueous metal complexes including at least one peroxo ligand, wherein said metals are selected from Groups IVB, VB, VIB and VIIB of the Periodic Table; and (ii) metal salts of a conjugate base of an acid or aqueous metal complexes of a conjugate base of an acid in which the metal is zinc.

55. The solution of claim 54, wherein the zinc salt or complex is present in solution at a concentration above 50 ppm.

56. An aqueous, acidic solution for forming a rare earth element containing conversion coating on the surface of a metal, said solution being chromium free and including effective quantities, sufficient to form said rare earth containing coating, of:

(a) one or more rare earth element-containing species including at least one rare earth element capable of having more than one higher valence state; and (b) one or more additives selected from the group consisting of:

(i) aqueous metal complexes including at least one peroxo ligand, wherein said metals are selected from Groups IVB, VB, VIB and VIIB of the Periodic Table; and (ii) metal salts of a conjugate base of an acid or aqueous metal complexes of a conjugate base of an acid in which the metal is manganese.

57. The solution of claim 56, wherein the manganese salt or complex is present in solution at a concentration above 100 ppm.

58. An aqueous, acidic solution for forming a rare earth element containing conversion coating on the surface of a metal, said solution being chromium free and including effective quantities, sufficient to form said rare earth containing coating, of:

(a) one or more rare earth element-containing species including at least one rare earth element capable of having more than one higher valence state; and (b) one or more additives selected from the group consisting of:

(i) aqueous metal complexes including at least one peroxo ligand, wherein said metals are selected from Groups IVB, VB, VIB and VIIB of the Periodic Table; and (ii) metal salts of a conjugate base of an acid or aqueous metal complexes of a conjugate base of an acid in which the metal is copper.

59. The solution of claim 58, wherein the copper salt or complex is present in solution at a concentration above 50 ppm.

* * * * *